US010163300B2

(12) United States Patent
Yarbrough

(10) Patent No.: US 10,163,300 B2
(45) **Date of Patent: *Dec. 25, 2018**

(54) SYSTEM AND METHOD FOR ENABLING A PLAYER PROXY TO EXECUTE A GAMING EVENT

(71) Applicant: Video Gaming Technologies, Inc., Franklin, TN (US)

(72) Inventor: Jon Yarbrough, Franklin, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/746,147

(22) Filed: Jun. 22, 2015

(65) Prior Publication Data

US 2015/0287283 A1 Oct. 8, 2015

Related U.S. Application Data

(63) Continuation of application No. 13/630,583, filed on Sep. 28, 2012, now Pat. No. 9,064,380, which is a continuation-in-part of application No. 13/548,980, filed on Jul. 13, 2012.

(51) Int. Cl.
*G07F 17/32* (2006.01)

(52) U.S. Cl.
CPC ..... *G07F 17/3244* (2013.01); *G07F 17/329* (2013.01); *G07F 17/3225* (2013.01); *G07F 17/3272* (2013.01); *G07F 17/3293* (2013.01)

(58) Field of Classification Search
CPC ..... G07F 17/3225; G07F 17/3272
See application file for complete search history.

(56) References Cited

U.S. PATENT DOCUMENTS

| | | | | |
|---|---|---|---|---|
| 5,830,067 | A | 11/1998 | Graves et al. | |
| 6,012,983 | A | 1/2000 | Walker et al. | |
| 6,244,957 | B1 | 6/2001 | Walker et al. | |
| 6,306,038 | B1 | 10/2001 | Graves et al. | |
| 7,997,974 | B2 | 8/2011 | Walker et al. | |
| 2002/0183105 | A1* | 12/2002 | Cannon | A63F 13/08 463/4 |
| 2003/0195043 | A1* | 10/2003 | Shinners | G07F 17/3276 463/42 |
| 2004/0043807 | A1* | 3/2004 | Pennington | G07F 17/32 463/13 |
| 2006/0052160 | A1* | 3/2006 | Saffari | G07F 17/32 463/27 |

(Continued)

*Primary Examiner* — Tramar Harper
*Assistant Examiner* — Jeffrey Wong
(74) *Attorney, Agent, or Firm* — Armstrong Teasdale LLP

(57) ABSTRACT

The gaming system that includes a first gaming machine operated by a first player at a first location and a second gaming machine operated by a second player at a second location. The second location is remote from the first. The first gaming machine is configured to present a game to the first player upon receipt of a wager from the first player. The second gaming machine is configured to present the game to the second player upon receipt of a wager from the second player. The gaming system further includes a processor programmed to receive a request to execute a game play event for the first player. In response to the request, the processor is configured to execute the game play event for the first player and the second player.

20 Claims, 7 Drawing Sheets

(56) References Cited

U.S. PATENT DOCUMENTS

| | | | | |
|---|---|---|---|---|
| 2007/0087820 | A1* | 4/2007 | Van Luchene | G07F 17/32 463/25 |
| 2008/0020848 | A1 | 1/2008 | Muir et al. | |
| 2012/0122590 | A1 | 5/2012 | Nguyen | |
| 2013/0053130 | A1* | 2/2013 | Zielinski | G07F 17/3244 463/25 |
| 2013/0130766 | A1* | 5/2013 | Harris | G07F 17/323 463/19 |

* cited by examiner

SYSTEM AND METHOD FOR ENABLING A PLAYER PROXY TO EXECUTE A GAMING EVENT

CROSS-REFERENCE TO RELATED APPLICATIONS

This application is a Continuation of pending U.S. patent application Ser. No. 13/630,583, filed Sep. 28, 2012, which is a Continuation-In-Part of pending U.S. patent application Ser. No. 13/548,980, filed Jul. 13, 2012, both of which are hereby incorporated by reference herein.

BACKGROUND OF THE INVENTION

The embodiments described herein relate generally to gaming machines and, more particularly, to systems and methods for enabling a player proxy to execute a game play event for another player.

To initiate a play of a game on a gaming machine, a player typically inserts a token/money/voucher into the gaming machine to establish credits on the gaming machine. The player then chooses the bet amount, the number of lines to bet, and begins the game by pressing a physical button, touching a particular part of a touch screen, or pulling a lever. If the game is a winner, a prize is given to the player in accordance with the outcome of the game, pay tables, and an amount wagered.

However, some games require a player to execute various actions throughout a play of the game. For example, in a classic bingo game, a player is required to place a wager, mark (e.g., daub) a bingo card as numbers are "called", recognize a winning pattern, and claim a prize. With a game like bingo, a time window may be allotted for a particular action (e.g., daubing) to be executed by the player. Thus, failure to execute the action within a predefined period of time results in the player forfeiting an ability to execute that particular action at that given time, which may also result in the player forfeiting a prize. While a player may be reminded that an action is needed (e.g., an input button on the gaming machine may flash, or an on-screen message may pop up reminding the player to, for example, daub the bingo card), due to factors such as distractions, forgetfulness, slow reactions, and the like, many players still miss the window of opportunity to execute a particular action and may lose a prize.

BRIEF DESCRIPTION OF THE INVENTION

In one aspect, a gaming system is provided. The gaming system includes a first gaming machine operated by a first player, the first gaming machine configured to present a game to the first player upon receipt of a wager by the first player, and a second gaming machine operated by a second player, the second gaming machine configured to present the game to the second player upon receipt of a wager by the second player. The gaming system further includes a processor programmed to receive, from the first player, a request to execute a game play event, and in response to receiving the request to execute the game play event from the first player, execute the game play event for the first player and the second player.

In another aspect, a method for enabling a player proxy to execute a game play event is provided. The method includes providing a game to a first player operating a first gaming machine upon receipt of a wager by the first player, providing the game to a second player operating a second gaming machine upon receipt of a wager by the second player, receiving, from the first player, a request to execute a game play event, and in response to receiving the request to execute the game play event from the first player, executing the game play event for the first player and the second player.

In yet another aspect, a method for enabling a player proxy to execute a game play event for another player is provided. The method includes providing a game to a first player operating a first gaming machine upon receipt of a wager by the first player, receiving, from the first player, a request to execute a game play event, and in response to receiving the request to execute the game play event from the first player, executing the game play event for the first player and a second player operating a second gaming machine, the first gaming machine and the second gaming machine being communicatively coupled in a peer-to-peer arrangement.

In yet another aspect, a gaming system is provided. The gaming system includes a first gaming machine operated by a first player at a first location and a second gaming machine operated by a second player at a second location. The second location is remote from the first. The first gaming machine is configured to present a game to the first player upon receipt of a wager from the first player for admittance to the game. The second gaming machine is configured to present the game to the second player upon receipt of a wager from the second player for admittance to the game. The gaming system further includes a processor programmed to receive a request to execute a game play event for the first player. In response to the request, the processor is configured to execute the game play event for the first player and the second player.

In yet another aspect, a method for enabling a player proxy to execute a game play event for another player is provided. The method includes providing, by a processor, a game to a first player operating a first gaming machine at a first location upon receipt of a wager from the first player. The method further includes providing, by the processor, the game to a second player operating a second gaming machine located at a second location upon receipt of a wager from the second player. The second location is remote with respect to the first location. The method further includes receiving a request to execute a game play event from the first gaming machine. The method further includes executing the game play event for the first player and the second player in response to receiving the request.

In yet another aspect, a method for enabling a player proxy to execute a game play event for another player is provided. The method includes providing, by a processor, a game to a first player operating a first gaming machine at a first location upon receipt of a wager from the first player. The method further includes receiving, from the first player, a request to execute a game play event. The method further includes, in response to receiving the request, executing the game play event for the first player and a second player operating a second gaming machine at a second location, the first gaming machine and the second gaming machine being communicatively coupled in a peer-to-peer arrangement.

DETAILED DESCRIPTION OF THE INVENTION

Exemplary embodiments of systems and methods for use in enabling a player proxy to execute a game play event associated with a game of chance or skill executed within a gaming system are described herein. Such embodiments allow a player proxy to execute a game play event for another player during play of a game of chance or skill. The player proxy may be chosen, for example, at random, by the player, by the game server, or based on a response time of a plurality of players or potential player proxies. Further, the game play event may be a wager prior to a play of a game of chance or skill, or the game play event may be an action to be executed during an actual play of the game of chance or skill (e.g., after a wager has been received).

Exemplary technical effects of systems and methods described herein include at least one of: (a) facilitating one player to serve as a proxy for multiple players in a game; (b) improving pace of play for a multiplayer game; (c) improving pace of play for multi-site games; and (d) reducing forfeited actions by players due to distraction and time limits.

Figure 1:
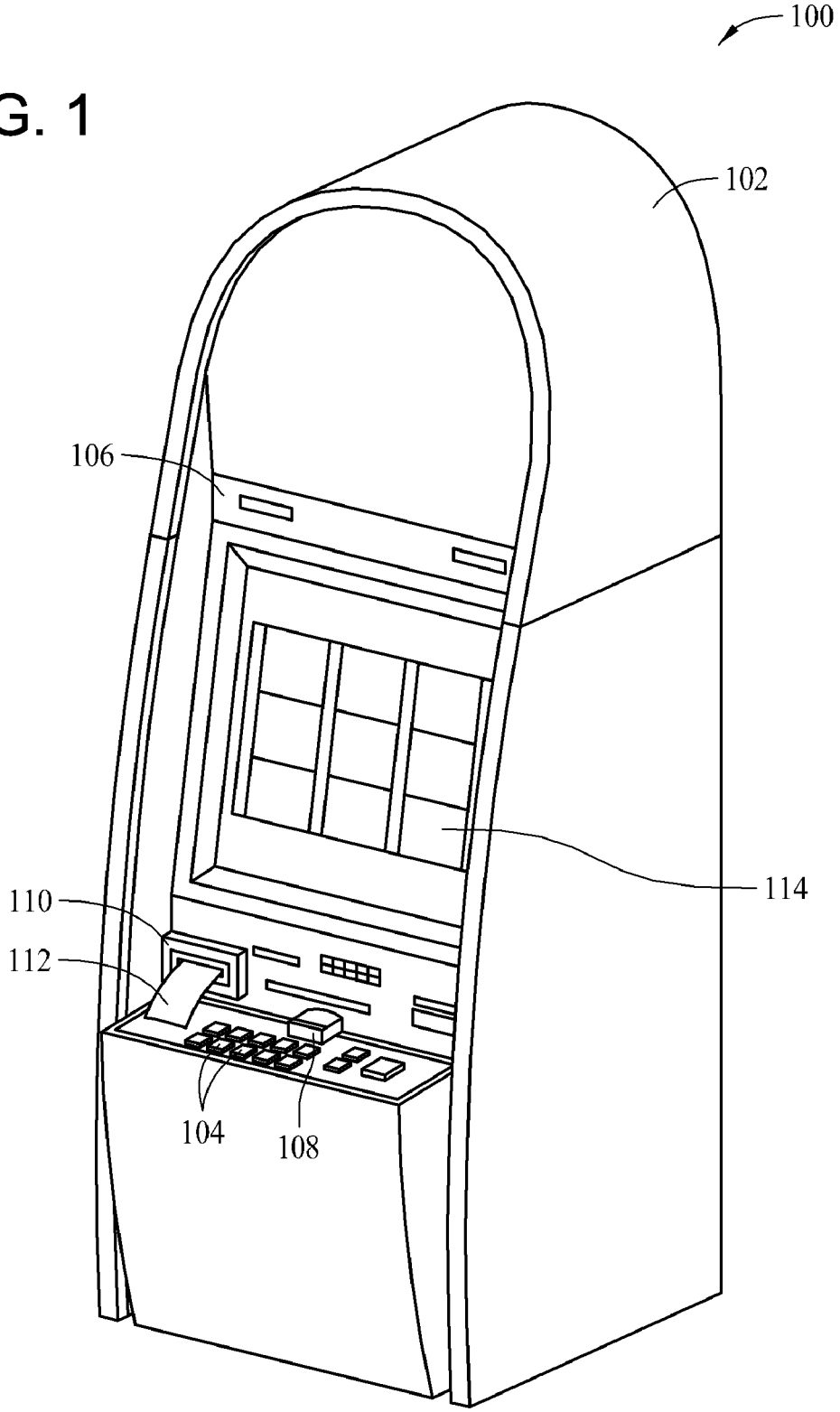
FIG. 1 is a schematic diagram of an exemplary gaming machine.

FIG. 1 is a schematic diagram of an exemplary gaming machine 100 that facilitates enabling a player proxy to execute a game play event for another player during a game, for example, a game of chance or a game of skill. In one embodiment, a game of chance or a game of skill may be one of the following: a bingo game, a centrally determined game, a card game, a slot game, a poker game, a pachinko game, a multiple hand poker game, a pai-gow poker game, a black jack game, a keno game, a roulette game, a craps game, a checkers game, and a board game.

Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a cabinet 102 configured to house a plurality of components, such as a gaming machine controller, peripheral devices, presentation devices, and player interaction devices. For example, in an exemplary embodiment, gaming machine 100 includes a plurality of input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher, which corresponds to a number of remaining credits.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more presentation devices 114. Presentation devices 114 are mounted to cabinet 102, and may include a primary presentation device for displaying a primary game and a secondary presentation device for displaying a secondary or bonus game. Presentation devices 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

In an exemplary embodiment, presentation device 114 is used to display one or more game images, symbols, and/or indicia such as a visual representation or exhibition of movement of an object (e.g., a mechanical, virtual, or video reel), dynamic lighting, video images, and the like. In an alternative embodiment, presentation device 114 displays images and indicia using mechanical means. For example, presentation device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator (RNG), a pseudo-random number generator (PNG), or any other suitable randomization process.

Figure 2:
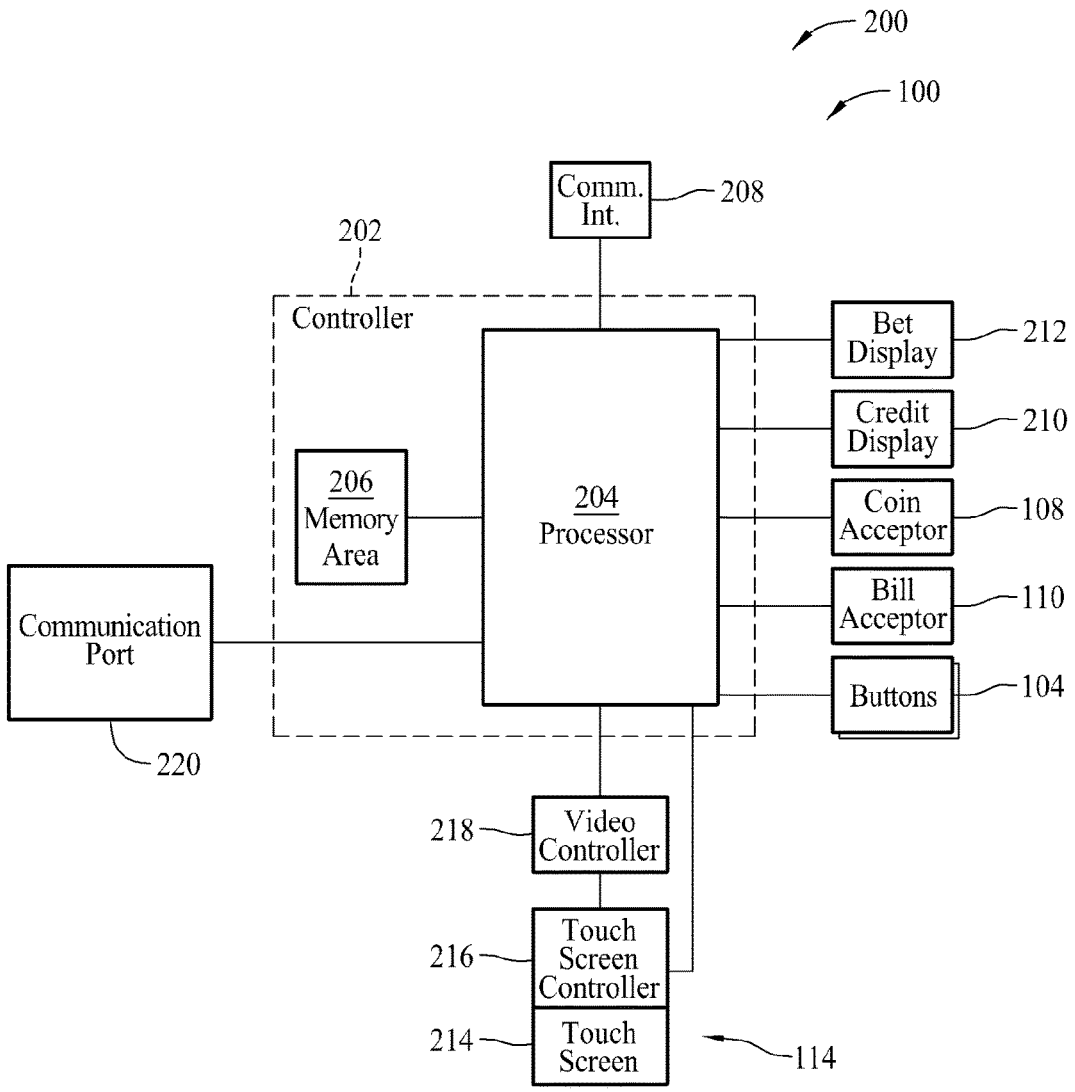
FIG. 2 is a schematic block diagram of an exemplary electrical architecture that may be used with the gaming machine shown in FIG. 1.

FIG. 2 is a schematic block diagram of an exemplary electrical architecture 200 that may be used with gaming machine 100. In the exemplary embodiment, gaming machine 100 includes a gaming machine controller 202 having a processor 204 communicatively coupled to a memory area 206. Moreover, in the exemplary embodiment, processor 204 and memory area 206 reside within cabinet 102 (shown in FIG. 1) and may be collectively referred to herein as a "computer" or "controller." Gaming machine 100 is configurable and/or programmable to perform one or more operations described herein by programming processor 204. For example, processor 204 may be programmed by encoding an operation as one or more executable instructions and providing the executable instructions in memory area 206.

Controller 202 communicates with one or more other gaming machines 100 or other suitable devices via a communication interface 208. Communication interface 208 may operate as an input device (e.g., by receiving data from another device) and/or as an output device (e.g., by transmitting data to another device). Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 206 stores program code and instructions, executable by processor 204, for controlling gaming machine 100. For example, memory area 206 stores data such as image data, event data, player input data, random or pseudo-random number generation software, pay table data, trigger event conditions, game play events, a list of predefined periods of time to execute the game play events, game play outcomes, and/or other information or applicable game rules that relate to game play on gaming machine 100. Moreover, memory area 206 may include one or more forms of memory. For example, memory area 206 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 206 by itself or in combination. In one embodiment, the above data and program code and instructions, executable by processor 204 for enabling a player proxy to execute a game play event may be stored and executed from a memory area remote from computing device gaming machine 100. For example, the data and the computer-executable instructions may be stored in a cloud service, a database, or other memory area accessible by gaming machine 100. Such embodiments reduce the computational and storage burden on gaming machine 100. As such, memory area 206 may be a local and/or a remote computer storage media including memory storage devices.

In the exemplary embodiment, gaming machine 100 includes a credit display 210, which displays a player's current number of credits, cash, account balance or the equivalent. Gaming machine 100 also includes a bet display 212, which displays a player's amount wagered. Credit display 210 and bet display 212 may be standalone displays independent of presentation device 114, or credit display 210 and bet display 212 may be incorporated into presentation device 114.

Moreover, in an exemplary embodiment, presentation device 114 is controlled by controller 202. In some embodiments, presentation device 114 includes a touch screen 214 and an associated touch screen controller 216. In such embodiments, presentation device 114 may operate as an input device in addition to presenting information. A video controller 218 is communicatively coupled to controller 202 and touch screen controller 216 to enable a player to input game play decisions (e.g., actions) into gaming machine 100 via touch screen 214. Furthermore, gaming machine 100 includes one or more communication ports 220 that enable controller 202 to communicate with external peripheral devices (not shown) such as, but not limited to, external video sources, expansion buses, other displays, a SCSI port, or a key pad.

Figure 3:
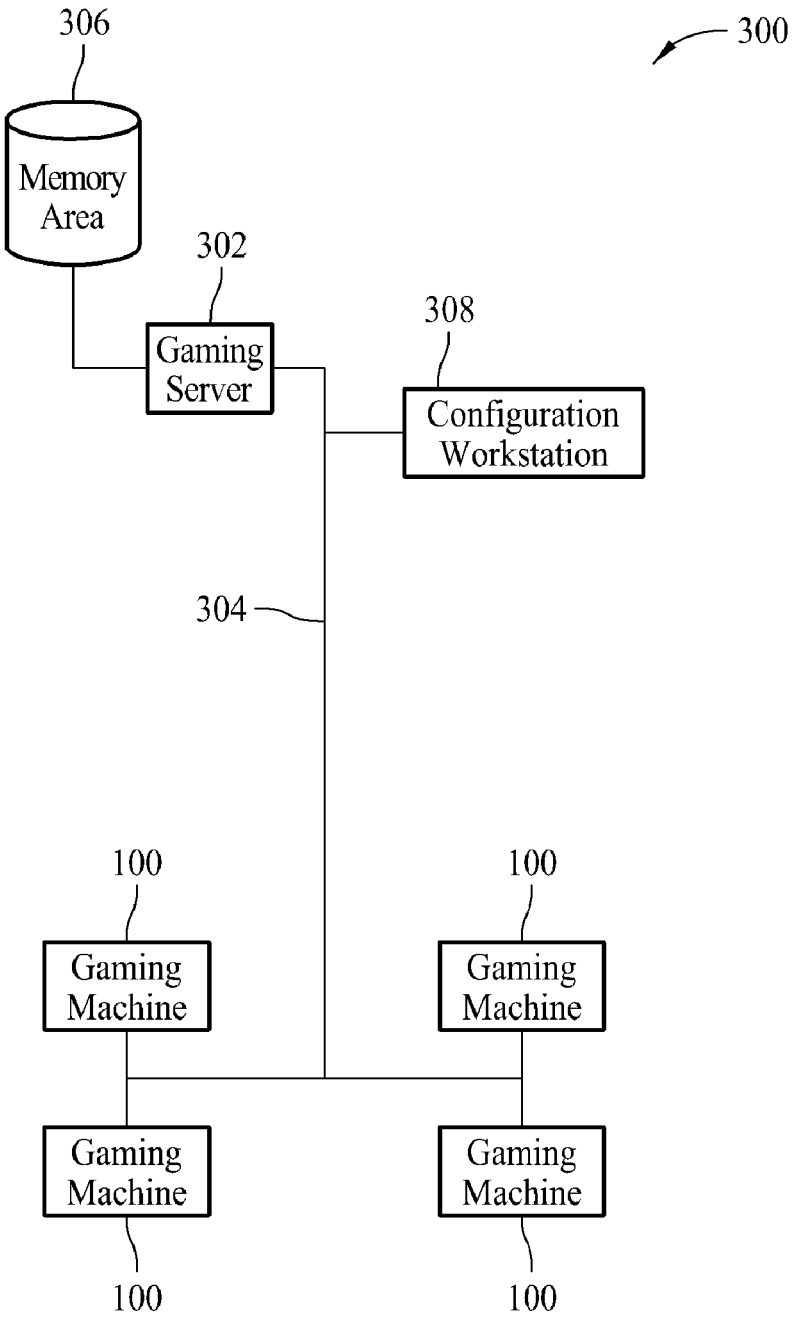
FIG. 3 is a block schematic diagram of an exemplary gaming system that includes a plurality of gaming machines shown in FIG. 1.

FIG. 3 is a block schematic diagram of an exemplary gaming system 300 that includes a plurality of gaming machines 100. Each gaming machine 100 is coupled via communication interface 208 (shown in FIG. 2) to one or more servers, such as a gaming server 302, using a network 304. Gaming server 302 includes a processor (not shown) that facilitates data communication between each gaming machine 100 and other components of gaming system 300. Such data is stored in, for example, a memory area 306, such as a database, that is coupled to gaming server 302.

In one embodiment, one or more gaming machines 100 may be remote gaming machines that access a casino over network 304. As such, a player is able to participate in a game on a remote gaming machine while a player proxy is physically present at, for example, a casino or some other location. In this embodiment, it will be understood that a player operating a remote gaming machine has virtual access to any casino coupled to network 304 and associated with gaming server 302. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game, remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 302. In such an embodiment, gaming machines 100 display results of a game via presentation device 114 (shown in FIGS. 1 and 2).

In one embodiment, gaming server 302 performs a plurality of functions including, for example, game outcome generation, executing a game play event for a player, player proxy selection, player tracking functions, and/or accounting functions, to name a few. However, in alternative embodiments, gaming system 300 may include a plurality of servers that separately perform these functions and/or any suitable function for use in a network-based gaming system.

In some embodiments, gaming server 302 provides a game, for example, a game of chance or a game of skill to a player operating one of gaming machines 100. As explained above, a time window (e.g., predefined period of time) may be allotted for a particular action in the game to be executed by the player and a failure to execute the action within the predefined period of time resorts in the player forfeiting an ability to execute that particular action at that given time. However, embodiments of the present disclosure enable gaming server 302 to send a request to a player proxy to execute a game play event for the player after the predefined period of time of inactivity has elapsed in the game. Thus, even though a player may have distractions, forgetfulness, slow reactions, and the like, embodiments of the present disclosure enable the predefined period of time to execute a particular action to not be missed.

Thus, in one embodiment, a predefined period of time (e.g., seconds, minutes, or a combination thereof) is a triggering event. The predefined period of time may begin at a point where an "action" is executable by a player. For example, a predefined period of time may begin once a ball is called in a bingo game, since the action of a player marking or "daubing" a particular square on a bingo card is executable once the ball is called. Therefore, when one or more balls are called, a player may have a predefined period of time (e.g., ten seconds) to daub a particular square on a bingo card until gaming server 302 enables a player proxy to daub the particular square for the player.

In another embodiment, a predefined period of time may be one or more missed game play events. For example, gaming server 302 may enable a player proxy to execute a game play event after a predefined number of game play events have been missed by the player. Alternatively, gaming server 302 may act as a player proxy by automatically executing a game play event for the player after, for example, a predefined period of time of inactivity.

In further embodiments, a predefined period of time may not be required. For example, an execution of a game play event by a player proxy may be based one or more of the following triggering events: a wager, a daub, and/or a prize claim action taken by any player (e.g., a player daubing his or her own card).

In yet another embodiment, a predefined period of time may not be required, and a triggering event for a player proxy action is generated automatically by gaming server 302 or by one of gaming machine 100. For example, a completion of each ball call event at game server 302 may serve as a triggering event to initiate a player proxy action for all players in the game. Gaming server 302 may broadcast a command over network 304 and initiate the player proxy process. Alternatively, after each ball call, gaming machine 100 may automatically start the player proxy process to execute the game play event at another of gaming machines 100. Further, an agreement accepted by a player to utilize a player proxy may constitute a triggering event. This agreement may be presented to a player prior to or after an initiation of a game.

In one embodiment, gaming server 302 can provide a game to each player operating one of gaming machines 100. In this embodiment, the first player to submit a request to execute a game play event is considered a player proxy for all players playing the bingo game. Further, once the request to execute a game play event is received by gaming server 302, gaming server 302 executes that game play event for the first player to submit the request as well as for all other players playing the bingo game, if applicable. That is, game server 302 performs a proxy action for all of the other players that have bingo cards that would be affected by the game play event. In this example, game events initiated by a player proxy (e.g., the first player to submit the request) are implemented by gaming server 302. In addition, bingo game results are also evaluated at gaming server 302 (e.g., not at each of the gaming machines 100). For example, all bingo cards issued in a bingo game may be held at gaming server 302, regardless of whether the bingo cards were generated at gaming server 302 or by gaming machines 100. Further, copies of the bingo cards may remain at the respective gaming machines 100 to enable each player an ability to monitor a progress of the bingo game.

Alternatively, selective proxy actions can also take place. That is, only designated proxy players can act on behalf of consented players. In this example, to keep track of the consented players and the designated proxy players who can act on behalf of the consented players, memory area 306 contains a map of proxy players, consented players that have a card issued to them, and ID's for each of the cards issued to the consented players.

A typical game play cycle for a bingo game implemented on gaming machines 100 will now be described with reference to FIG. 3. Initially, a player requests to place a wager on a game. Thereafter, gaming server 302 accesses a directory, brief description, and a schedule of all available games from memory area 306 and sends the information to the player. In one embodiment, choosing an amount wagered per chance/bingo card and/or how a proxy for the player is selected during the game is predefined by, for example, gaming server 302. However, once the player has selected a game (e.g., a bingo game), and prior to a start of the bingo game, gaming server 302 may also query the player as to a preference on these strategic decisions. For example, gaming server 302 may determine an amount a player wants to wager per chance/bingo card and/or how a player proxy for the player is to be selected. As such, this information may be stored in memory area 306 and used to limit the necessary player interaction during a play of a game.

When a time before a start of a particular bingo game is less than a preset time, gaming server 302 notifies each player that the game is closed. When the bingo game begins, gaming server 302 accepts a ball drawing result after a ball is called. Once an identification of the ball is established, gaming server 302 correlates the identification of the ball with each player's bingo card(s). If, upon receipt of a triggering event (e.g., after a predefined period of time a player does not mark or "daub" all of his cards in play), gaming server 302 enables a player proxy to daub the cards for the player by selecting an appropriate input on the gaming machine operated by the player proxy. In one embodiment, the player proxy may be chosen at random by gaming server 302, by the player, or based on a response time of a plurality of potential proxies (e.g., a first player to respond is the player proxy request). Next, gaming server 302 checks to see if any of the bingo cards or chances have fulfilled the criteria for a prize. If the criteria for a prize have been fulfilled, the winning card is displayed and a corresponding player acknowledges ownership in the winning card by selecting an appropriate input on the gaming machine operated by the player.

In addition, gaming server 302 may also track data of players using gaming machines 100. For example, gaming server 302 can store physical characteristics of players, such as, but not limited to, a gender of a player and an age of a player. Gaming server 302 can also track and store other data related to the players using player tracking identification, such as a player card. For example, gaming server 302 can store information about a player, such as loyalty points, player address, phone number, and/or any information that may be retrieved and transmitted to gaming machines 100. In some embodiments, gaming server 302 stores and tracks information such as, but not limited to, an average amount of a wager played at gaming machines 100, any funds a player may have in an account, as well as data relating to reportable events.

Figure 4:
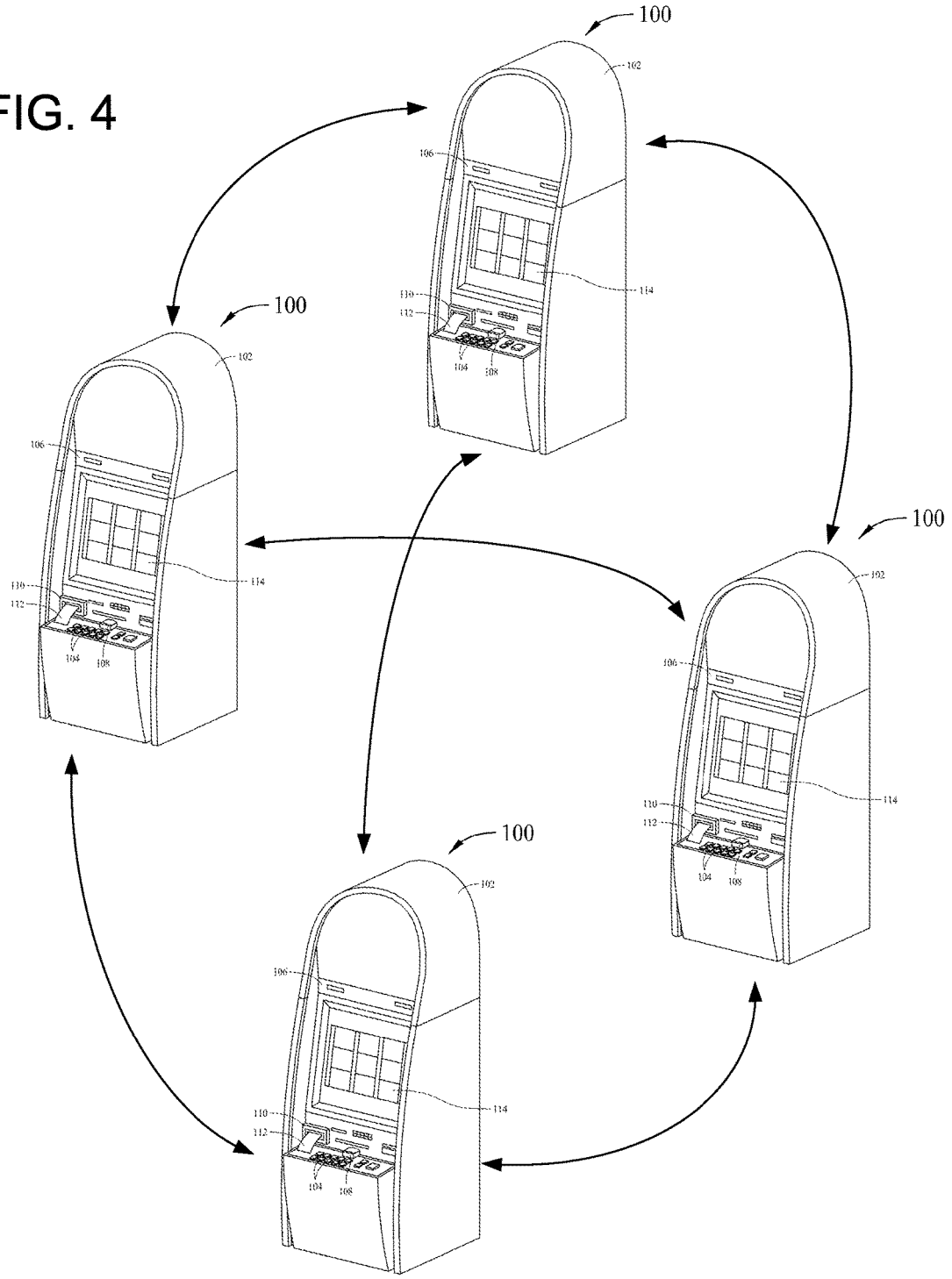
FIG. 4 is a block schematic diagram of an exemplary peer-to-peer gaming system that includes a plurality of gaming machines shown in FIG. 1.

With reference now to FIG. 4, a serverless embodiment of the present disclosure is provided. In this embodiment, game play events are broadcast in a peer-to-peer fashion, that is, without an intermediary of a gaming server (e.g., gaming server 302). FIG. 4 shows a system 400 of interconnected gaming machines 402, 404, 406 and 408. System 400 is one in which each gaming machine (e.g., gaming machines 402, 404, 406, and 408) is a peer to every other gaming machine. In such a peer-to-peer arrangement, each gaming machine can send and receive data to and from other gaming machines in system 400. Thus, in contrast with a client-server relationship and other server-based arrangements, gaming system 400 does not require a gaming server to serve gaming machines 402, 404, 406, and 408 in system 400.

Figure 5:
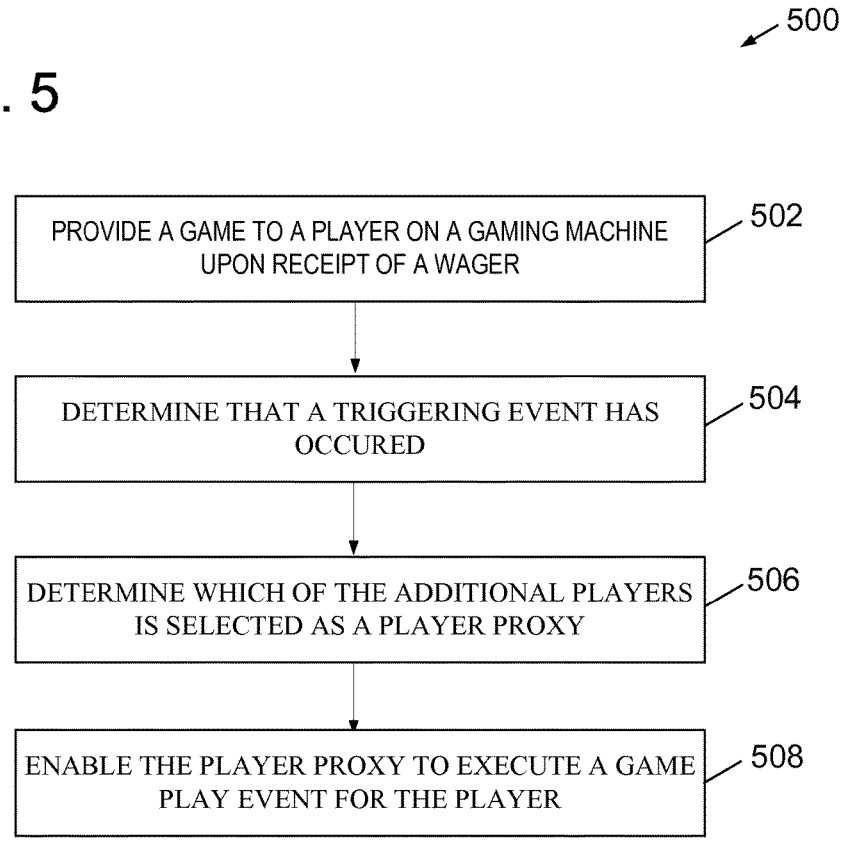
FIGS. 5-7 are flowcharts that illustrate exemplary methods for enabling a player proxy to execute a game play event.

With reference now to FIG. 5, a flowchart that illustrates an exemplary method 500 for use with gaming system 300 (shown in FIG. 3) is provided. Operations in method 500 may be performed by one or more gaming machines 100, by gaming server 302, and/or by any other computing device or combination thereof. In exemplary embodiments, and referring to FIGS. 2, 3, and 5, a game is provided to a player on a gaming machine (e.g., one of gaming machines 100) at 502 upon receipt of a wager from the first player. At 504, a triggering event is determined to have occurred. As mentioned above, a triggering event may be one or more of the following: an elapsed predefined period of time of inactivity by the player, a wager, a daub, a prize claim. In some implementations, when a predefined period of time is not required, the first action (wager, daub, or claim) taken by any player in the game may serve as the triggering event, or the game server may automatically generate a triggering event at a predefined game state, such as, at the end of each ball call.

Once the triggering event occurs, a request to execute a game play event for the player is sent to one or more additional players (e.g., possible player proxies). In one embodiment, a predefined period of time may be allotted for a particular action (e.g., daubing a card in bingo) to be executed and a failure to execute the action within the predefined period of time enables another player (e.g., a player proxy) to execute the action (e.g., game play event) for the player. For example, during a bingo game, when a ball inscribed with a certain number is called, gaming server 302 may send an instruction to a player operating gaming machine 100 as to which position on a bingo card to mark or "daub". These daubing instructions may be communicated in terms of a position on a bingo card (e.g., each square on a bingo card is given a daub identification number from one to twenty-five). The daubing identification number is then sent to communication interface 208 to display on presentation device 114 of gaming machine 100. In further embodiments, a triggering event may be a receipt of a request by an additional player to execute a game play event for the player.

At 506, a determination is made as to which of the additional players is selected as a player proxy. In one embodiment, based on a triggering event, the request to execute a game play event for the player is sent to each player playing the game (e.g., a bingo game). Gaming server 302 may determine the player proxy by identifying which of the plurality of additional players is first to execute the request. In another embodiment, the player proxy may be pre-defined/selected either by gaming server 302 or by the player prior to initiating the game.

At 508, gaming server 302 enables the player proxy to execute a game play event for the player. In some embodiments, the game play event is associated with a wager, for example, a wager to initiate an additional game or a request to change a wager to a particular amount. In addition, a game play event may be associated with acknowledging an outcome of the game (e.g., acknowledging a "bingo" has occurred). In one embodiment, gaming server 302 receives the game play event via an input device (e.g., a button 104 or touch screen 214) on gaming machine 100 associated with the player proxy. In addition, or alternatively, gaming server 302 may receive the game play event from gaming machine 100 associated with the player proxy via a communication interface, such as communication interface 208.

In one embodiment, after the player proxy executes the game play event for the player, gaming server 302 disables an ability of player proxy to execute an additional game play event for the player until an additional predefined period of time of inactivity by the player has elapsed. Thus, in this embodiment, a predefined period of time must elapse each time prior to player proxy having authorization to execute a game play event for the player. In another embodiment, gaming server 302 enables an ability of player proxy to execute all game play events for the player until a request from the player to execute a game play event himself, or a player proxy revocation request by the player, or a termination signal of the game play session, is received.

One of ordinary skill in the art, guided by the teaching herein will appreciate that one or more operations in method 500 may be performed repeatedly. For example, game play events may be received repeatedly, and at least a portion of the steps described above may be performed based on each game play event.

Figure 6:
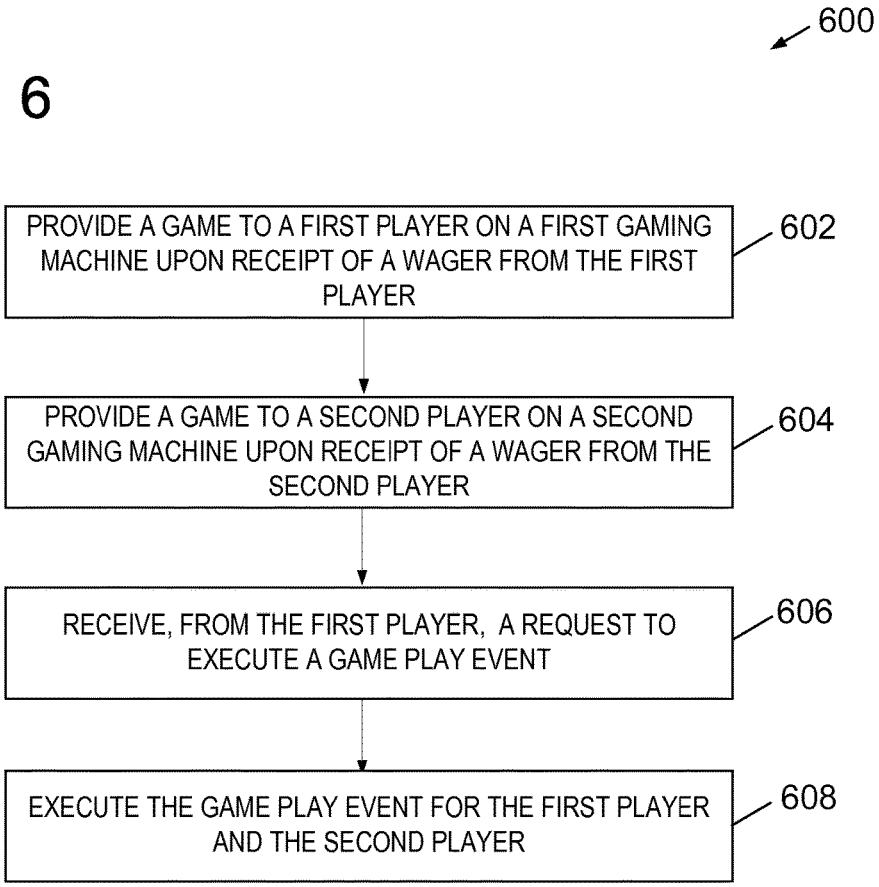

With reference now to FIG. 6, a flowchart that illustrates an exemplary method 600 for use with gaming system 300 (shown in FIG. 3) is provided. In one embodiment, operations in method 600 may be performed by gaming server 302, one or more of gaming machines 100, or any combination thereof. In exemplary embodiments, and referring to FIGS. 2, 3, and 6, a game is provided to a first player on a first gaming machine (e.g., one of gaming machines 100) at 602 upon receipt of a wager from the first player, and the game is also provided to a second player on a second gaming machine (e.g., another of gaming machines 100) at 604 upon receipt of a wager from the second player. At 606, a request to execute a game play event (e.g., daub a bingo card) is received from the first player. In response to receiving the request to execute the game play event from the first player, at 608 the game play event is executed for the first player and the second player. In this embodiment, the first player to submit a request to execute a game play event is considered a player proxy for all players playing the bingo game. Thus, in this example, the first player submitted the request prior to the second player submitting a request. As such, the first player is the player proxy for the second player for requested action (e.g., executing the game play event). Once the request to execute a game play event is received (e.g., by gaming server 302), that game play event is executed for the first player as well as for all other players playing the bingo game (e.g., the second player), if applicable. That is, a proxy action is executed for all of the other players that have bingo cards that would be affected by the game play event. As such, while the first player may be the player proxy on executing the gaming event described above, the second player may be the player proxy for the first player on another action if the second player is the first to request execution. That is, a player proxy can be determined each time an applicable action (e.g., daub) is requested.

In one embodiment, after a gaming session is initiated, a copy or a script that describes a bingo card issued to the second player is forwarded to a proxy player for the second player (e.g., the first player). Thus, when the first player performs an action (e.g., executes a game play event) as he/she plays his/her own bingo card, this action affects the second player's bingo card, which is present at the first player's gaming machine. In this embodiment, game results for the first player's card and the second player's card are determined by the first player's gaming machine even though entitlement to prizes remains with the respective owner of each card. Once the game is complete, a message containing game results regarding the second player's card is sent to the second player's gaming machine and thereafter, the game is rendered. In one embodiment, during play of the game, the second player is not aware of the various transactions that took place on the first player's gaming machine.

In another embodiment, if the first player is determined to be the player proxy for the second player for a certain period of time (e.g., not just for a particular action as described above), only an ID of the second player's card and a network address of the second player's gaming machine may be forwarded to the first player's gaming machine. Using this approach, when the player proxy (e.g., the first player) executes a game play event (e.g., daubs), a command is sent from the first player's gaming machine to the second player's gaming machine to enable the second player's card to have the game play event performed in it. That is, the second player's original card is maintained at the second player's gaming machine. In this embodiment, the game results are determined at the players' respective gaming machines. Thus, neither the first player nor the first player's gaming machine has knowledge of game results associated with the second player's card in which the first player is the player proxy for. That is, the first player has "access" to the second player's card (e.g., card ID and gaming machine ID), and can specify a game play event to be executed on the second player's behalf, but the first player cannot affect game outcomes for the second player as the second player maintains control of the original card at the second player's gaming machine.

One of ordinary skill in the art, guided by the teaching herein will appreciate that one or more operations in method 600 may be performed repeatedly. For example, game play events may be received repeatedly, and at least a portion of the steps described above may be performed based on each game play event.

Figure 7:
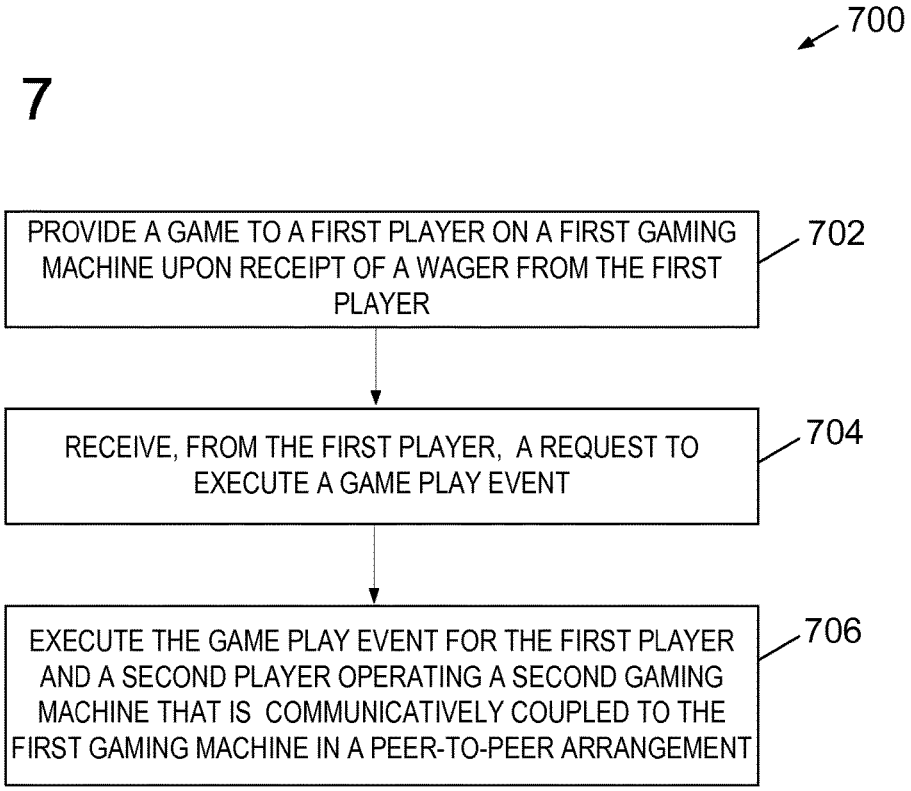

With reference now to FIG. 7, a flowchart that illustrates an exemplary method 700 for use with gaming system 400 (the peer-to-peer gaming system shown in FIG. 4) is provided. In one embodiment, operations in method 700 may be performed by two or more gaming machines 100. In exemplary embodiments, and referring to FIGS. 2, 4, and 7, a game is provided to a first player on a first gaming machine (e.g., one of gaming machines 100) at 702 upon receipt of a wager from the first player. At 704, a request, from the first player, to execute a game play event is received. At 706, in response to receiving the request to execute the game play event from the first player, the game play event for the first player and a second player operating a second gaming machine is executed. That is, being that the first gaming machine and the second gaming machine are communicatively coupled in a peer-to-peer arrangement, game play events, game results, bingo cards, card IDs, and gaming machine IDs are broadcast in a peer-to-peer fashion, that is, without an intermediary of a gaming server (e.g., gaming server 302). In such a peer-to-peer arrangement, each gaming machine can send and receive data to and from other gaming machines.

One of ordinary skill in the art, guided by the teaching herein will appreciate that one or more operations in method 700 may be performed repeatedly. For example, game play events may be received repeatedly, and at least a portion of the steps described above may be performed based on each game play event.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, New York; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming system comprising:

a first gaming machine operable by a first player at a first location, the first gaming machine configured to present a game to the first player upon receipt of a wager from the first player in exchange for a first admission to the game, the first gaming machine comprising at least one of a coin acceptor and a bill acceptor for establishing a first credit balance from which the wager from the first player is deducted;

a second gaming machine operable by a second player at a second location, the second gaming machine configured to present the game to the second player upon receipt of a wager from the second player in exchange for a second admission to the game, the second gaming machine comprising at least one of a coin acceptor and a bill acceptor for establishing a second credit balance from which the wager from the second player is deducted, wherein the second location is remote with respect to the first location; and a processor executing instructions stored in a memory which cause the processor to at least:

receive a request from the second player of the second gaming machine to provide an ability to the first player of the first gaming machine to execute at least one player action on behalf of the second player;

receive a request from the first gaming machine to execute a player action for the first player;

execute the player action for the first player on the first gaming machine;

execute a same player action for the second player on the second gaming machine in response to receiving the request from the first gaming machine to execute the player action for the first player, wherein executing the player action for the first player and the second player is carried out before receiving a request execute a player action from the second gaming machine, and wherein executing the player action comprises determining a winning player and claiming a prize for the game;

determine a first game outcome in response to the player action executed for the first player on the first gaming machine;

determine a second game outcome in response to the same player action executed for the second player on the second gaming machine, wherein the first game outcome is different from and independent of the second game outcome; and receive a request from the second player of the second gaming machine to terminate the ability of the first player to execute the at least one player action on behalf of the second player.

2. The gaming system in accordance with claim 1 further comprising a server communicatively coupled to each of the first gaming machine and the second gaming machine, wherein the server comprises the processor.

3. The gaming system in accordance with claim 2, wherein the instructions when executed by the processor further cause the processor to provide the game to each of the first player and the second player.

4. The gaming system in accordance with claim 1, wherein executing the same player action for the first player and the second player is carried out before receiving a request to execute the same player action for the second player.

5. The gaming system in accordance with claim 1, wherein the game is a card game, wagers for admission to the first game are in exchange for a hand of cards, and the player action for the first player is selected from the group consisting of:

selecting at least one card to hold, choosing whether to change an amount of the wager received from the first player, choosing a bet position, choosing a side bet, and evaluating a result of the game.

6. The gaming system in accordance with claim 5, wherein the instructions when executed by the processor further cause the processor to:

provide a first hand of cards assigned to the first player to the first gaming machine; and provide a second hand of cards assigned to the second player to the second gaming machine.

7. The gaming system in accordance with claim 6, wherein the processor is disposed in a game server, and wherein the instructions when executed by the processor further cause the processor to determine results of the game for the first player and the second player, and wherein the instructions when executed by the processor further cause the processor to forward the results of the game for the first player and the second player from the game server to first gaming machine and the second gaming machine.

8. The gaming system in accordance with claim 1, wherein the first gaming machine and the second gaming machine are communicatively coupled in a peer-to-peer arrangement, and wherein the first gaming machine comprises the processor.

9. The gaming system in accordance with claim 8, wherein the first game is a bingo game comprising a bingo card, and wherein the player action for the first player is daubing the bingo card.

10. The gaming system in accordance with claim 9, wherein the instructions when executed by the processor further cause the processor to:

provide a first bingo card to the first player; and receive, from the second gaming machine, a second bingo card assigned to the second player;

wherein receiving a request to execute the player action for the first player comprises receiving, from the first player, a request to daub the first bingo card; and wherein executing the same player action for the second player comprises daubing the second bingo card.

11. The gaming system in accordance with claim 10, wherein instructions when executed by the processor further cause the processor to:

determine results of the bingo game for the second player; and forward the results of the bingo game for the second player from the first gaming machine to the second gaming machine.

12. The gaming system in accordance with claim 1, wherein the second gaming machine comprises a handheld web-enabled computing device.

13. A method for enabling a player proxy to execute a player action for another player, the method comprising:

providing, by a processor, a game to a first player operating a first gaming machine at a first location upon receipt of a wager from the first player, the first gaming machine including at least one of a coin acceptor and a bill acceptor for establishing a first credit balance from which the wager from the first player is deducted;

providing, by the processor, the game to a second player operating a second gaming machine located at a second location upon receipt of a wager from the second player, the second gaming machine including at least one of a coin acceptor and a bill acceptor for establishing a first credit balance from which the wager from the first player is deducted, wherein the second location is remote with respect to the first location;

providing a first game play dataset for the first player to the first gaming machine;

providing a second game play dataset for the second player to the first gaming machine;

receiving a request to execute a player action for the first player from the first gaming machine;

executing the player action for the first player and the second player in response to receiving the request to execute the player action for the first player, wherein executing the player action for the first player and the second player is carried out before receiving a request to execute the player action from the second gaming machine, and wherein executing the player action comprises determining a winning player and claiming a prize for the game;

determining a first game outcome in response to the player action executed for the first player and a second game outcome in response to the player action executed for the second player, wherein the first game outcome is independent of the second game outcome, and wherein the second game outcome is determined by the first gaming machine based on the first game play dataset and the second game play dataset; and forwarding the second game outcome from the first gaming machine to the second gaming machine.

14. The method in accordance with claim 13, further comprising receiving a request from the second player of the second gaming machine to provide an ability to the first player of the first gaming machine to execute at least one player action on behalf of the second player.

15. The method in accordance with claim 14, further comprising receiving a request from the second player of the second gaming machine to terminate the ability of the first player to execute the at least one player action on behalf of the second player.

16. A method for enabling a player proxy to execute a player action for another player, the method comprising:

providing, by a processor, a poker game to a first player operating a first gaming machine at a first location upon receipt of a wager from the first player, the first gaming machine including at least one of a coin acceptor and a bill acceptor for establishing a first credit balance from which the wager from the first player is deducted;

providing a first hand of cards to the first player; and receiving, from a second gaming machine at a second location, a second hand of cards assigned to a second player, wherein the first gaming machine and the second gaming machine are communicatively coupled in a peer-to-peer arrangement;

receiving, from the first gaming machine for the first player, a request to execute a player action;

in response to receiving the request, executing the player action for the first player and the second player, wherein executing the player action for the first player and the second player comprises claiming a prize for a winning hand based on a comparison of the first hand and the second hand; and determining a first game outcome in response to the player action executed for the first player and a second game outcome in response to the player action executed for the second player, wherein the first game outcome is independent of the second game outcome.

17. The method in accordance with claim 16 further comprising:

determining results of the poker game for the second player; and forwarding the results of the poker game for the second player from the first gaming machine to the second gaming machine.

18. The method in accordance with claim 16 further comprising determining, at the second gaming machine, results of the poker game for the second player.

19. The method in accordance with claim 16, further comprising receiving a request from the second player of the second gaming machine to provide an ability to the first player of the first gaming machine to execute at least one player action on behalf of the second player.

20. The method in accordance with claim 19, further comprising receiving a request from the second player of the second gaming machine to terminate the ability of the first player to execute the at least one player action on behalf of the second player.

* * * * *